US008534205B1

(12) United States Patent
Johnson et al.

(10) Patent No.: US 8,534,205 B1
(45) Date of Patent: Sep. 17, 2013

(54) FOLDING TABLE

(75) Inventors: Mitch Johnson, South Weber, UT (US); Brandon Smith, South Ogden, UT (US); Jay Calkin, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 13/546,670

(22) Filed: Jul. 11, 2012

(51) Int. Cl.
*A47B 3/02* (2006.01)

(52) U.S. Cl.
USPC ..... 108/132; 108/169

(58) Field of Classification Search
USPC ..... 108/132, 129, 167, 166, 169, 170, 108/171, 173, 174, 175, 38, 35, 34, 36
See application file for complete search history.

(56) References Cited

U.S. PATENT DOCUMENTS 5,357,872 A * 10/1994 Wilmore ..... 108/35
D413,218 S * 8/1999 Doty ..... D6/511
6,561,107 B1 * 5/2003 Wood et al. ..... 108/132
7,140,308 B2 * 11/2006 Tsai ..... 108/169
7,461,601 B2 * 12/2008 Jin et al. ..... 108/132
7,461,752 B2 * 12/2008 Li ..... 211/194
7,640,870 B2 * 1/2010 Strong et al. ..... 108/132
7,707,948 B2 * 5/2010 Lin ..... 108/169
7,735,431 B2 * 6/2010 Neunzert et al. ..... 108/132
8,091,490 B2 * 1/2012 Branch et al. ..... 108/169
2010/0170423 A1 * 7/2010 Chang ..... 108/167

* cited by examiner

*Primary Examiner* — Jose V Chen
(74) *Attorney, Agent, or Firm* — Maschoff Brennan

(57) ABSTRACT

A fold-in-half table may include a first half constructed from molded plastic, such as blow-molded plastic, and a second half constructed from a wire rack. An inner engagement surface of the first half of the table top may engage an inner engagement surface of the second half of the table top when the table is in the unfolded position. The first and second inner engagement surfaces may be spaced apart when the table is in the folded position. The fond-in-half table may also include first and second support structures connected to the first and second halves of the table top and the support structures may be movable between an extended position and a collapsed position relative to the table top.

20 Claims, 14 Drawing Sheets

FOLDING TABLE

BACKGROUND

1. Field of the Invention

The present invention generally relates to structures including at least a portion constructed from plastic and, in particular, to furniture, such as tables and chairs, that may include molded plastic components.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against the table top. Conventional tables with relatively large table tops and folding legs are often referred to as "banquet tables" and these tables are frequently used in assembly halls, banquet halls, convention centers, hotels, schools, churches and other locations where large groups of people meet. These types of tables can often be positioned in an assortment of different configurations and used in a variety of settings. When the banquet tables are no longer needed, the table legs can be moved into the storage position and the tables may be more easily moved or stored.

Tables are also often used for other purposes such as displaying items, allowing objects to be easily accessed and eating. For example, one or more persons can eat at a table, and tables can be used to display and allow access to food such as at a picnic, banquet or other type of gathering.

Many conventional tables include table tops constructed from relatively light-weight materials such as plastic. Conventional tables may include a frame that is connected to the table top. The frame may include a pair of side rails that are connected to sides of the table top using fasteners. Undesirably, when a large load or force is applied to some known tables, the table top and/or frame may bend or deform. In addition, the fasteners used to connect the frame to the table top may detach or separate from the table top. The fasteners may even damage and tear through the table top if the load or force exceeds a certain amount. Further, the frames or fasteners of some known tables may collapse in some circumstances.

BRIEF SUMMARY

A need therefore exists for a table that eliminates or diminishes the above-described disadvantages and problems.

One aspect is a table that may include a table top and one or more support structures or legs sized and configured to support the table top above a surface such as the floor or ground. The table may also include a frame and the legs connected to the frame. The legs may be movable relative to the table top between a collapsed or storage position and an extended or use position. In particular, the legs may be pivoted between a collapsed position in which the legs are disposed at least proximate a lower surface of the table top and an extended position in which the legs extend outwardly from the table top. If desired, the legs may at least partially contact or abut the lower surface of the table top when the legs are in the collapsed position.

Another aspect is a table that may be folded-in-half, which may facilitate moving and storage of the table. For example, the table may include a table top with a first portion and a second portion that are movable between a use position in which an upper surface of the first and second portions are generally aligned, and a storage position in which the first and second portions are at least partially folded together and disposed in generally adjacent or proximate positions. The first and second portions of the table top may pivot or rotate, for instance, between the use and storage positions.

Still another aspect is a table that may include a table top with sections that are constructed from different materials and processes. In particular, a first section or half of the table top may be constructed from materials and processes that are different from a second section or half of the table top. Desirably, the first half of the table top may have a first set of qualities, properties, characteristics and/or features that are significantly different than the qualities, properties, characteristics and/or features of the second half of the table top. Advantageously, this may allow the different halves of the table top to be used for different purposes. Significantly, this may greatly increase the potential uses and environments in which the table can be used. For example, the first half of the table top may be used for storing, displaying and/or supporting items or objects with one or more features or characteristics. The second half of the table top may be used for storing, displaying and/or supporting items or objects with one or more different features or characteristics than the first half of the table top.

Yet another aspect is a table that may include a table top with a first half constructed from plastic and a second half constructed from a metal grid. The plastic and metal halves of the table top are preferably connected by one or more hinges to create a fold-in-half table. Advantageously, the plastic half of the table top may have a first set of qualities, properties, characteristics and features that are significantly different than the qualities, properties, characteristics and features of the metal half of the table top. For example, the plastic half of the table top may be used for preparation and displaying of food at relatively low temperatures so as not to melt or deform the plastic. On the other hand, the metal half of the table top may be used for cooking, heating and/or displaying hot items. In particular, these hot items may be at temperatures that would melt or deform the plastic.

Still yet another aspect is a table that may be relatively lightweight, which may allow the table to be more easily transported and moved. For example, the table may include a lightweight table top and that may reduce the overall weight of the table. In particular, a first portion of the table top may be constructed from plastic, such as blow-molded plastic, which may create a table top that is relatively rigid, high-strength and capable of withstanding repeated use and wear. The blow-molded plastic portion of the table top may be relatively quickly, easily and efficiently manufactured. In addition, the blow-molded plastic portion of the table top may be readily molded into the desired size and shape. The blow-molded plastic portion of the table top may be relatively lightweight because, for instance, it may include a hollow interior portion that is integrally formed during the blow-molding process. The blow-molded plastic portion of the table top may further include two opposing walls, which may be spaced apart by a generally constant and/or predetermined distance, and that may help increase the strength and rigidity of the table top. Additionally, the blow-molded plastic portion of the table top may be generally weather resistant and temperature insensitive. Further, the blow-molded plastic portion of the table top may not corrode, rust or otherwise deteriorate over an extended period of time, which may help create a long-lasting table.

A further aspect is a table top that may include a portion constructed from blow-molded plastic and one or more features may be integrally formed during the molding process as part of a unitary, one-piece construction. For example, the molded plastic table top may include one or more depressions (also referred to as "tack-offs") and the depressions may be designed to increase the strength of the table top and/or interconnect the spaced apart walls. The depressions may also be sized and configured to create a structure with particular characteristics and qualities, such as a table top with generally uniform strength, rigidity and/or structural integrity. The molded plastic table top may also include other features such as structures that increase the strength, rigidity and/or torsion resistance of at least a portion of the table top.

A still further aspect is a table top that may include a portion constructed from metal such as a wire rack. The wire rack may be constructed from a number of wires that may have a hollow or solid construction. The wires may have a generally cylindrical configuration with a plurality of interlocking and/or overlapping portions that may be welded and/or otherwise interconnected. The wires may also be disposed in a grid or lattice configuration with a number of openings or holes that extend through this portion of the table top.

Another further aspect is a table that may include components that can be quickly and easily manufactured. For example, the plastic and metal portions of the table top, and the legs and side rails of the frame may be relatively straightforward to manufacture. In addition, the legs and/or side rails of the frame may be quickly and easily attached to the table top, which may reduce manufacturing costs. The table may also be constructed from only a few parts and a limited number of fasteners may be required, which may allow the table to be quickly and easily assembled by the manufacturer, retailer and/or consumer.

Yet another further aspect is a table that may include a frame with a first portion disposed along one side of the table top and a second portion disposed along a second side of the table top. In particular, the frame may include a first side rail disposed along a first side of the table top and a second side rail disposed along a second side of the table top. The side rails may extend along the length and/or width of the table top and the side rails may help support the table top and/or facilitate connection of the legs to the table top. Each side rail may include a body and may be constructed from relatively strong materials such as metal.

Still yet another further aspect is a table that may include a frame and a portion of the frame may be disposed along an edge or perimeter of the table top. For example, the first portion of the table top may be constructed from blow-molded plastic and it may include a downwardly extending lip that is integrally formed with the table top during the blow-molding process as part of a unitary, one-piece construction. The second portion of the table top may be a wire rack and it may include a downwardly extending lip that is integrally formed from wire as part of a unitary, one-piece construction. The frame may include a first side rail disposed at least proximate a portion of the lip of the blow-molded plastic portion of the table top and the wire rack portion of the table top. The frame may further include a second side rail disposed at least proximate an opposing portion of the lip of both the blow-molded plastic and wire rack portions of the table top. Advantageously, the frame may support both the blow-molded plastic and wire rack portions of the table top. The lower portion of the frame may be aligned with a lower portion of the lip constructed from blow-molded plastic and/or the wire rack.

Another aspect is a table that may include a table top with a plurality of openings in the upper surface. For example, the first half or section of the table top may be constructed from blow-molded plastic and it may include a generally planar upper surface without any openings in the upper surface. The second half or section of the table top may include a plurality of openings because it may be constructed from a wire rack. The openings may have a generally consistent size and shape, such as square, rectangular, oval or the like. Advantageously, the openings may facilitate heat transfer and/or allow high-temperature items to be placed on the wire rack such as heated pots, pans and the like. The wire rack portion of the table top may also allow cooking and other activities to be conducted at elevated temperatures that may not be possible on the blow-molded plastic portion of the table top. The openings in the wire rack portion of the table top may extend along at least a majority, substantially all or the entire length and/or width of the table top. While the openings in the table top may have generally the same size, shape, configuration and arrangement, the openings could also have different sizes, shapes, configurations and arrangements. For example, the openings along the sides and/or lip of the wire rack portion of the table top may be smaller than the openings proximate a center portion of the table top, by a factor such as two, three, four, five, ten, or more.

Still another aspect is a table that may include a frame that contacts, engages and/or supports a lip and/or outer perimeter of the table top. Advantageously, if the frame is disposed along the outer edges of the table top, then the frame may provide increased support for the edges or extremities of the table top. In addition, if a portion of the frame is disposed below or proximate the lip, then the frame may help prevent the table top from being damaged. For example, the frame may absorb impacts or forces that otherwise may damage the table top.

Yet another aspect is a table that may include a frame and leg assemblies that are constructed from relatively strong and durable materials such as metal, steel and the like. It will be appreciated, however, that the frame and leg assemblies may be constructed from other materials with suitable properties and characteristics. In addition, the table, frame, leg assemblies and the like may have a variety of other suitable shapes, sizes, configurations and arrangements depending, for example, upon the intended use of the table.

Still yet another aspect is a table that may include a table top at least partially constructed from blow-molded plastic and the plastic portion of the table top may include a plurality of depressions. The plurality of depressions may be closely spaced and may cover at least a majority, substantially all, virtually all or all of a lower surface of the table top. The plurality of depressions may also be disposed in a generally uniform pattern in which the depressions have generally the same size, shape configuration, orientation and arrangement. In addition, at least a majority of the depressions in the plurality of depressions may be spaced apart from one or more adjacent depressions by a generally consistent or uniform distance. Advantageously, the depressions may help create a table top with increased strength, rigidity and/or structural integrity. Additionally, if the depressions in the plurality of depressions are generally uniformly spaced and disposed in a generally uniform pattern, that may help create a table top with generally uniform characteristics.

A further aspect is a fold-in-half table may include a table top with a first half constructed from molded plastic and a second half constructed from metal. The first half may include a first inner engagement surface that extends across at least a portion of a width of the first half of the table top and the second half may include a second inner engagement surface that extends across at least a portion of a width of the second half of the table top. The first inner engagement surface may be disposed at least proximate the second inner engagement surface when the table is in the unfolded position. On the other hand, the first inner engagement surface may be spaced apart from the second inner engagement surface when the table is in the folded position. In addition, the first inner engagement surface and the second inner engagement surface may be generally aligned and disposed in a plane when the table is in the folded position. Advantageously, the first inner engagement surface may be integrally formed with the first half of the table top as part of a unitary, one-piece structure.

A still further aspect is a fold-in-half table in which the first half of the table top may have a first set of characteristics and properties, the second half of the table top may have a second set of characteristics and properties, and the first set of characteristics and properties may be different than the second set of characteristics and properties. Additionally, a plurality of openings may be disposed in the second half of the table top and the openings may cover at least a substantial portion of an upper surface of the second half of the table top. A plurality of openings may also be disposed in a lip of the second half of the table top.

Another further aspect is a table top that may include a first half with an upper surface, a lower surface, a hollow interior and a first inner engagement surface that are integrally formed during a molding process as part of a unitary, one-piece construction. The second half of the table top may include a wire rack with a second inner engagement surface. The first inner engagement surface and the second inner engagement surface may be generally aligned and disposed in a plane when the table is in the folded position. In addition, the wire rack may form the second half of the table top or the wire rack is disposed within a border in the second half of the table top.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of exemplary embodiments to further illustrate and clarify the above and other aspects, advantages and features of the present invention. It will be appreciated that these drawings depict only exemplary embodiments of the invention and are not intended to limits its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF PREFERRED EMBODIMENTS

The present invention is generally directed towards tables. The principles of the present invention, however, are not limited to tables. It will be understood that, in light of the present disclosure, the tables disclosed herein can have a variety of shapes, sizes, configurations and arrangements. In addition, while the tables shown in the accompanying figures are banquet or utility tables, it will be appreciated the tables may have any suitable style or configuration such as round, personal, conference or card tables. Further, the invention disclosed herein may be successfully used in connection with other types of furniture and/or structures.

Additionally, to assist in the description of preferred embodiments of the tables, words such as top, bottom, front, rear, right and left may be used to describe the accompanying figures which may be, but are not necessarily, drawn to scale. It will further be appreciated the tables can be disposed in a variety of desired positions or orientations, and used in numerous locations, environments and arrangements. A detailed description of preferred embodiments the table now follows.

Figure 1:
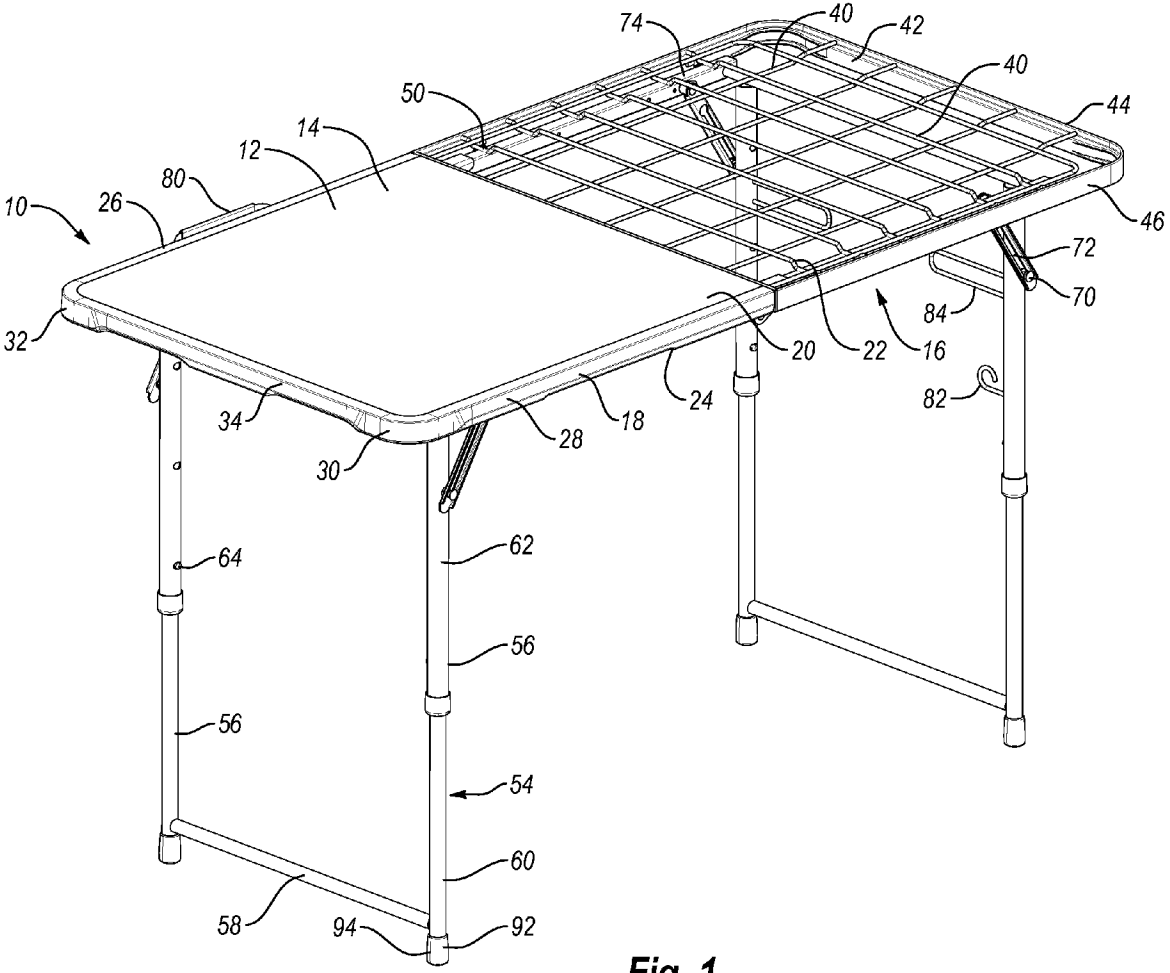
FIG. 1 is an upper perspective view of an exemplary table.
Figure 2:
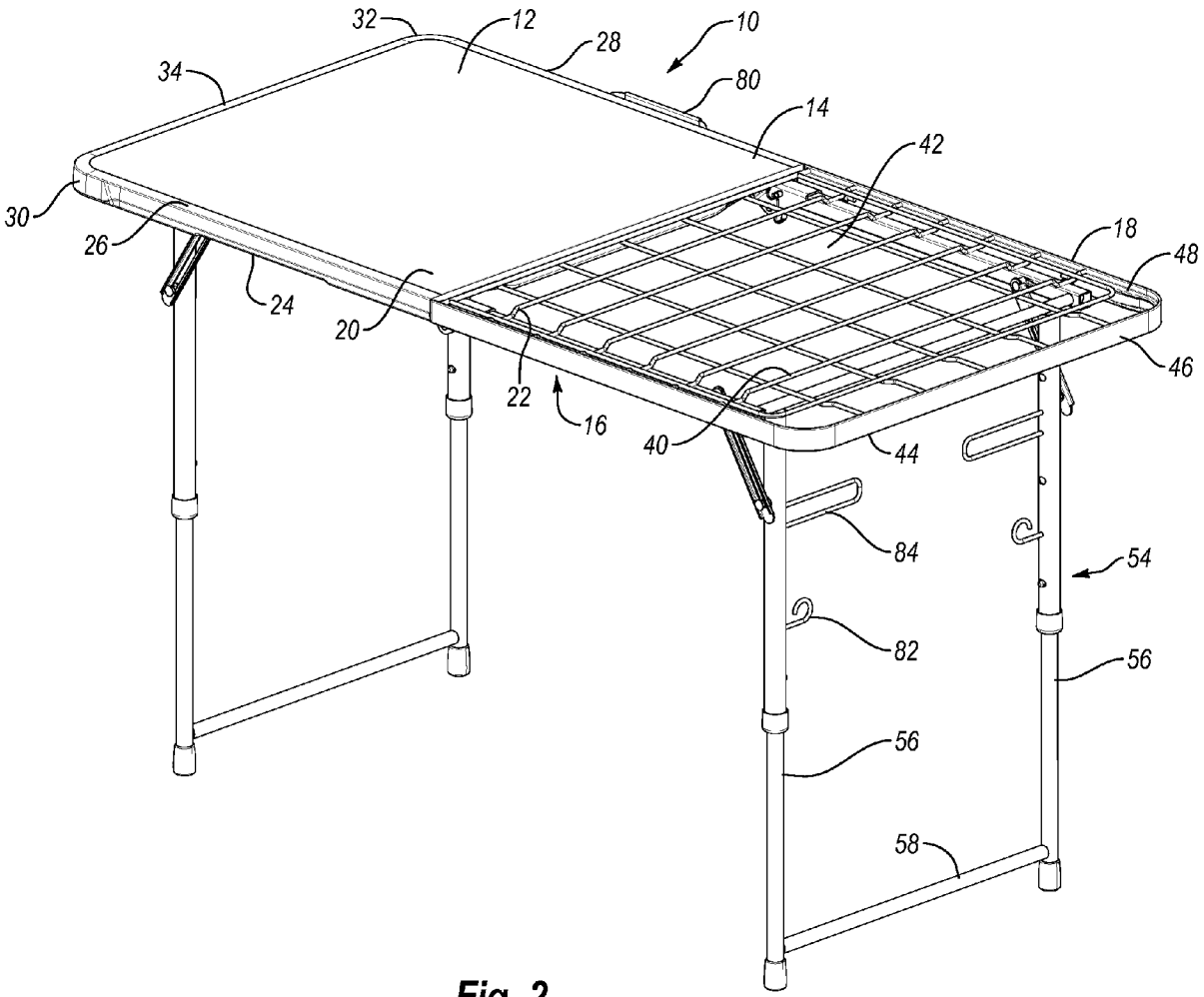
FIG. 2 is another upper perspective view of the table shown in FIG. 1.
Figure 3:
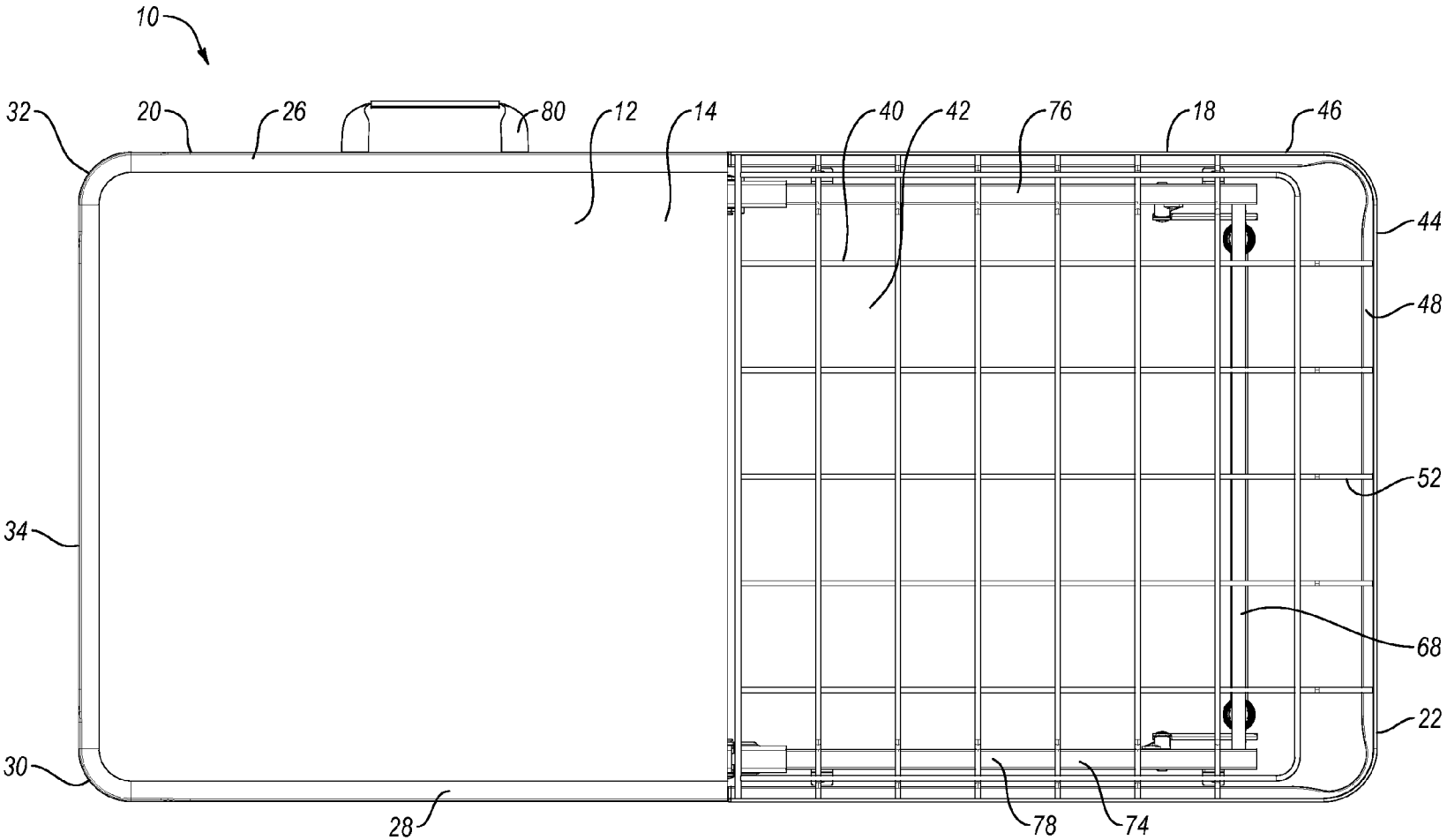
FIG. 3 is a top view of a portion of the table shown in FIG. 1.

As shown in FIGS. 1 and 2, an exemplary table 10 may include a table top 12 with an upper surface or portion 14, a lower surface or portion 16, and a perimeter 18. The table top 12 may include a first portion 20 and a second portion 22. As shown in the accompanying figures, the first portion 20 may form a half of the table top 12 and the second portion 22 may form the other half of the table top. In addition, the table 10 may be a fold-in-half table and the first and second portions 20, 22 of the table top 12 may be movable between a use position in which the upper surfaces 14 of the table top are generally aligned and a collapsed or storage position. It will be appreciated the table top 12 may have various shapes and sizes such as rectangular, square, round, oval and the like. It will also be appreciated that the first and second portions 20, 22 may form any desired portions of the table top 12, and the first and second portions may have various shapes and sizes depending, for example, upon the intended use of the table 10.

The first and second portions 20, 22 of the table top 12 may be constructed from different materials and processes. For example, the first portion 20 may have a first set of qualities, properties, characteristics and/or features and the second portion 22 may have a second set of qualities, properties, characteristics and/or features. If desired, the first and second portions 20, 22 of the table top 12 may have significantly different qualities, properties, characteristics and/or features. Advantageously, this may allow the different portions 20, 22 of the table top 12 to be used for different purposes, which may greatly increase the potential uses of the table 10.

For example, a portion of the table top 12, such as the first portion 20, may be constructed blow-molded plastic. The blow-molded plastic portion 20 of the table top 12 may include the upper surface 14 that is spaced apart from the lower surface 16 by a distance, which may be a generally constant distance. The blow-molded plastic portion 20 may also include a hollow interior portion disposed between the upper and lower surfaces 14, 16 of the table top 12. In addition, the first portion 20 of the table top 12 may include a lip 24, which may extend downwardly from the lower portion 16 of the table top. The first portion 20 of the table top 12 may further include sides 26, 28; corners 30, 32; and an end 34. The first portion 20 of the table top 12—which may include the upper surface 14, the lower surface 16, the lip 24, the sides 26, 28, the corners 30, 32 and the end 34—may be integrally formed as part of a unitary, one-piece structure during the blow-molding process. It will be appreciated that the first portion 20 of the table top 12 may also be formed using other processes such as injection molding, rotary molding and the like; and the table top may be constructed from other materials with suitable characteristics.

Figure 5:
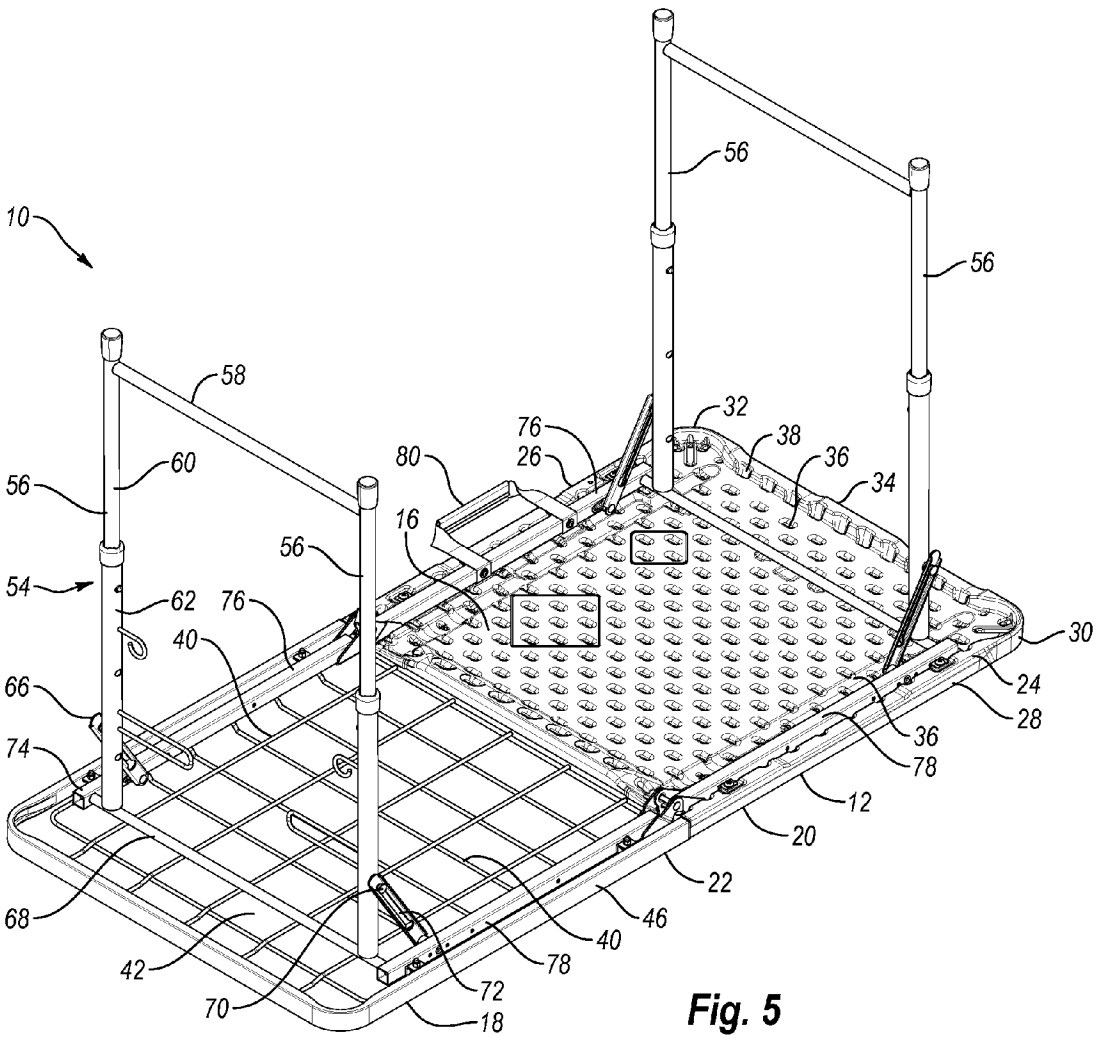
FIG. 5 is a lower perspective view of the table shown in FIG. 1.
Figure 6:
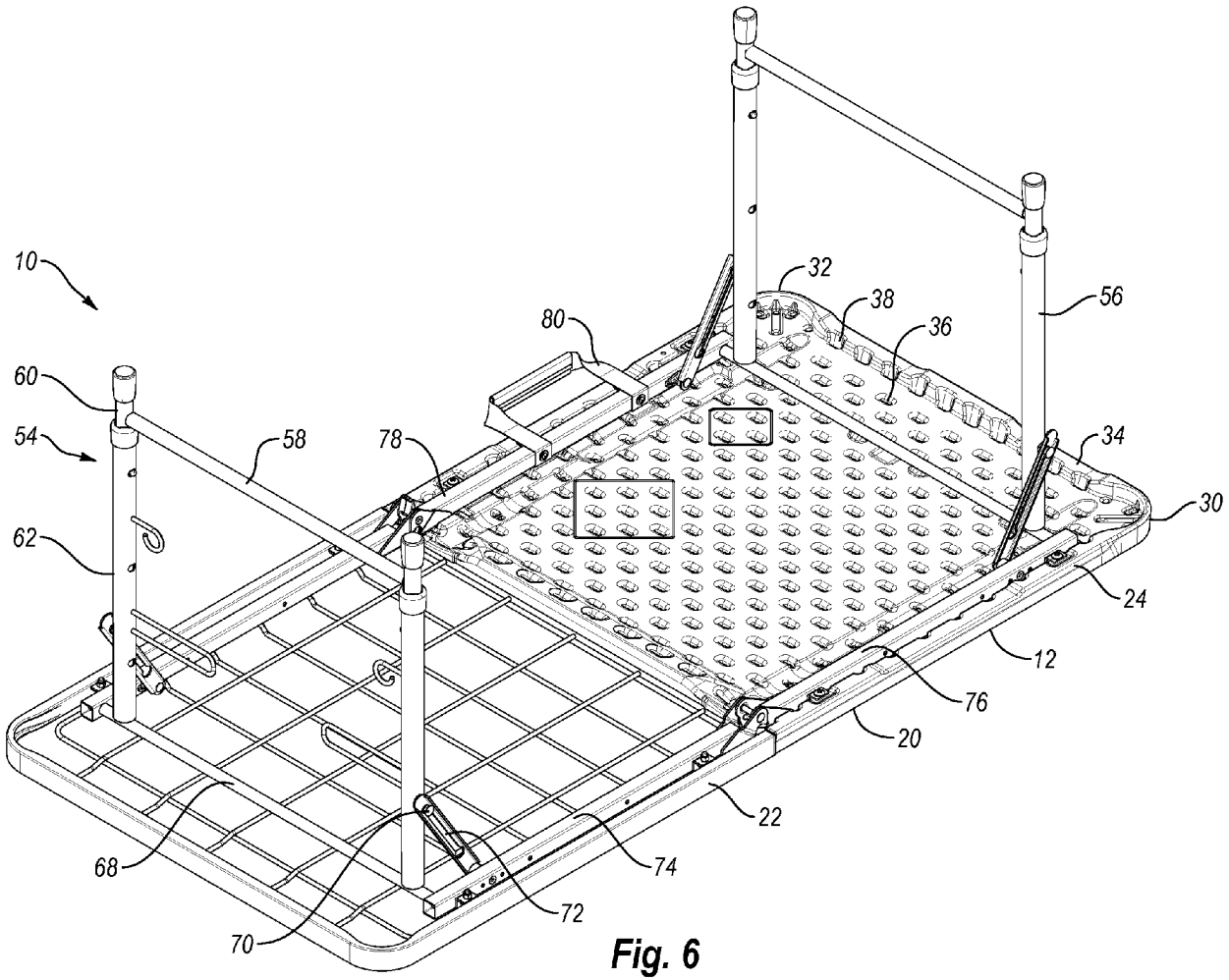
FIG. 6 is another lower perspective view of the table shown in FIG. 1, illustrating the legs in a retracted position.
Figure 7:
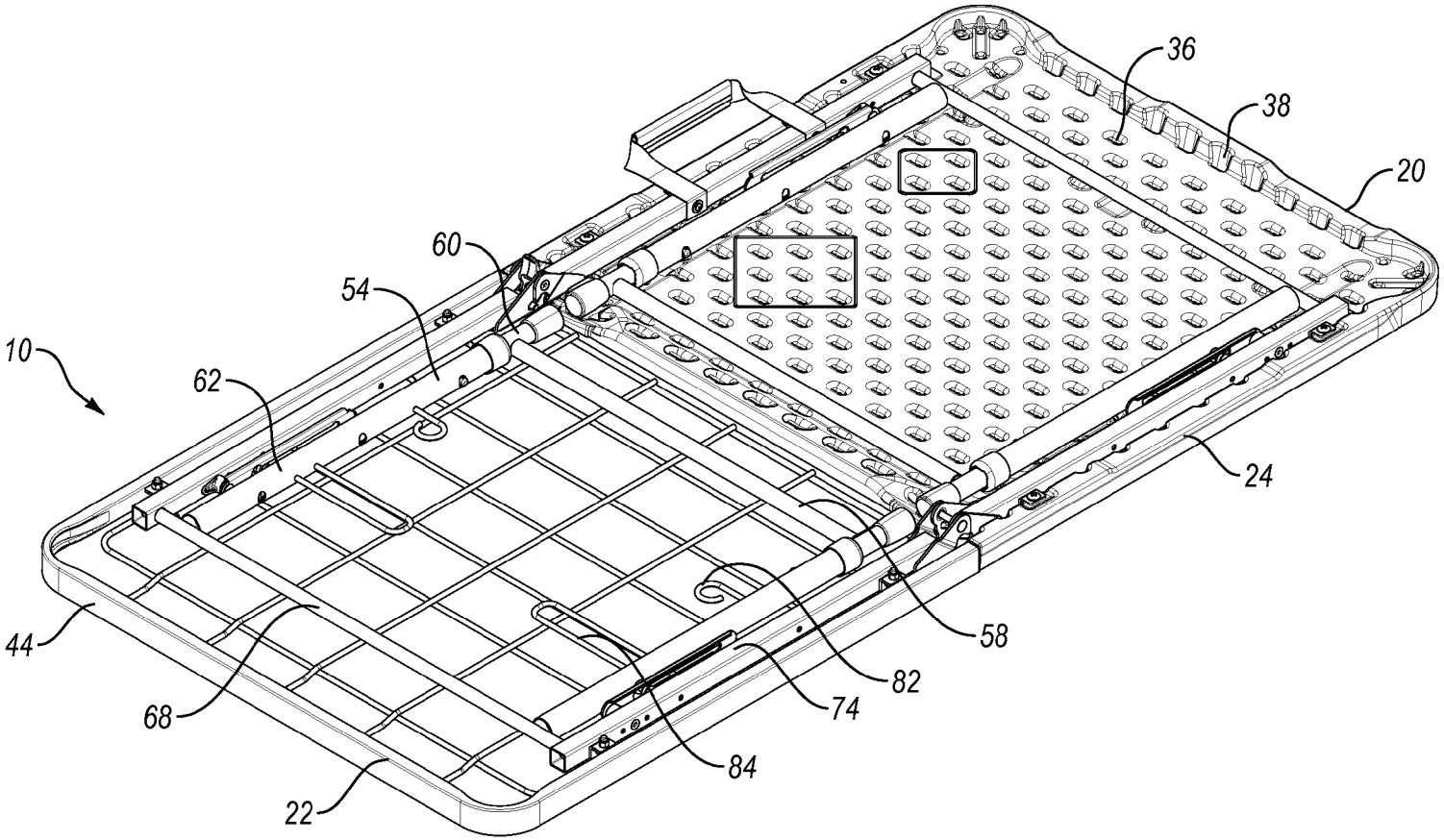
FIG. 7 is still another lower perspective view of the table shown in FIG. 1, illustrating the legs in the retracted position and a folded or collapsed position.

As shown in FIGS. 5-7, the first portion 20 of the table top 12 may include a number of depressions 36 formed in the lower surface 16. The depressions 36 may be disposed in a generally uniform pattern that covers at least a substantial portion or almost the entire lower surface 16 of the table top 12. The depressions 36 may have generally the same size, shape, configuration and arrangement, and the depressions may be spaced apart from adjacent depressions by a generally constant distance. In addition, the depressions 36 may be aligned in a number of rows and/or columns that extend along a width and/or length of the table top 12. Further, adjacent rows and/or columns of the depressions 36 may be offset and the depressions may be aligned with the lip 24 and/or other portions of the table. The first portion 20 of the table top 12 could also include one or more strengthening members 38 which could be integrally formed in the lip 24; sides 26, 28; corners 30, 32; and/or end 34. Additional information concerning depressions, strengthening members and other features that may be included in the table 10 are disclosed in U.S. Pat. Nos. 7,069,865; 7,111,563; 7,475,643; 7,814,844; and 8,042,476; each of which are incorporated by reference in its entirety. In addition, the table 10 may have other suitable features and configurations, such as disclosed in Assignee's U.S. patent application Ser. No. 11/372,515, entitled HIGH-STRENGTH, LIGHTWEIGHT BLOW-MOLDED PLASTIC STRUCTURES, filed Mar. 9, 2006, currently pending, which is incorporated by reference in its entirety.

The second portion 22 of the table top 12 may be constructed from one or more supports 40. The supports 40 may be interconnected in a predetermined pattern and may form a grid, lattice, network, and the like. The supports 40 may consist of one or more wires, bars, beams, links, cross members and the like, and the supports may intertwine, interlock and/or overlap. In addition, the supports 40 may be connected by means such as welding, adhesives, and the like.

The supports 40 are preferably constructed from a relatively high-strength material such as metal. Additionally, the supports 40 are preferably constructed from a material that is heat-resistant or may withstand a relatively large amount of heat for purposes such as cooking. Therefore, the supports 40 may be constructed from high-strength steel, but it will be understood the second portion 22 of the table top 12 may be constructed from other materials with suitable characteristics.

The metal supports 40 may be disposed in a generally consistent and uniform pattern. For example, the metal supports 40 may be spaced apart by a generally constant distance and the metal supports may be disposed in a series of rows and columns that extend along the length and width of the second portion 22 of the table top 12. In addition, the metal supports 40 may be disposed in a generally parallel configuration and the supports may be disposed in a generally perpendicular arrangement.

The second portion 22 of the table top 12 may include a plurality of openings or holes 42 disposed between the metal supports 40. The openings 42 may have a generally square or rectangular configuration and may be formed by two generally parallel supports disposed in a first direction and two generally parallel supports disposed in a second direction. The openings 42 may cover the majority, substantially all or the entire upper surface 14 of the second portion 22 of the table top 12. It will be appreciated the openings 42 may have other shapes, sizes, configurations and/or arrangements depending, for example, upon the intended use of the table 10.

Figure 4:
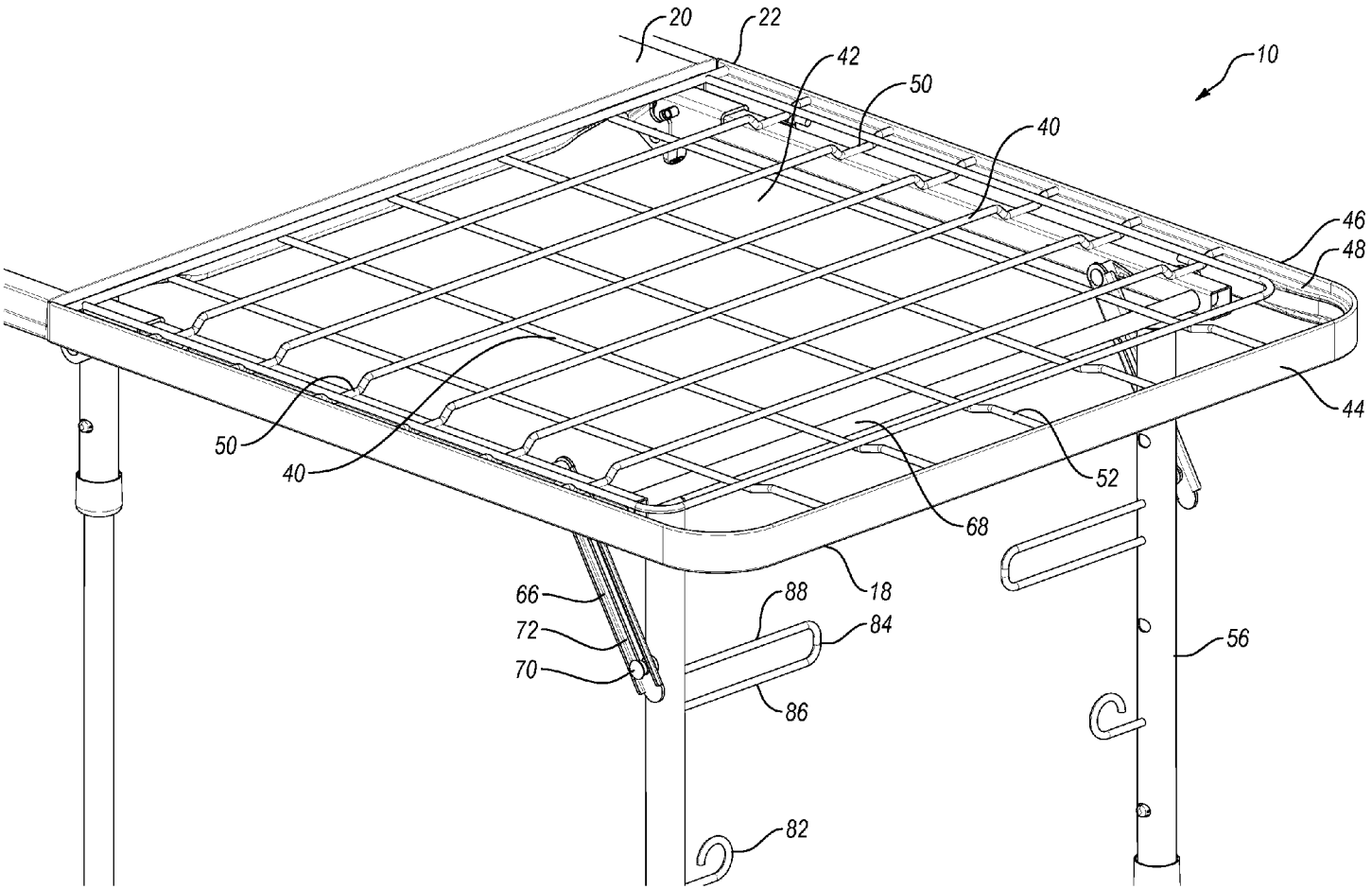
FIG. 4 is an enlarged perspective view of a portion of the table shown in FIG. 1, illustrating a wire rack portion of the table top.

The second portion 22 of the table top 12 may also include an edge 44 that forms at least a portion of the outer perimeter 18. The edge 44 may be formed by an outer wall 46 that is disposed generally perpendicular to the upper surface 14 of the table top 12. As best seen in FIG. 4, the supports 40 may be connected to the outer wall 46. The outer wall 46 may have generally the same size and configuration as the outer surface of the lip 24, which may help create an aesthetically pleasing table 10. The outer wall 46, however, could have other suitable shapes, sizes, configurations and arrangements. Further, the outer wall 46 is not required.

The outer wall 46 may include one or more inwardly extending flanges 48 to facilitate attachment of the supports 40 to the outer wall. In addition, the supports 40 may include one or more bends, curves, and the like to align ends 50 of the supports with the flanges 48. For example, as shown in FIG. 4, the ends 50 of the supports 40 extending across a width of the second portion 22 of the table top 12 may include downwardly extending portions disposed proximate the outer wall 46. The ends 52 of the supports 40 extending across a length of the second portion 22 of the table top 12 may include upwardly extending portions disposed proximate the outer wall 46. Advantageously, an upper surface of the supports 40 and the outer wall 46 may be generally disposed in the same plane to create a generally planar, level upper surface 14 of the second portion 22 of the table top 12.

The table 10 may also include a one or more support structures 54, which may be sized and configured to support the table top 12 above a surface such as the floor or ground. The support structures 54 may include one or more legs 56 and a connecting member 58 may interconnect the legs. The length of the support structures 54 is preferably adjustable. For example, the legs 56 legs may include a pair of telescoping members in which a first member 60 is movable or slidable within a second member 62 to allow the height of the support structure 54 to be adjusted. A locking member 64, such as a pin or detent, may be used to secure the legs 56 at the desired height.

The support structures 54 may be movable between an extended or use position in which the legs 56 extend outwardly relative to the table top 12 and a collapsed or storage position in which the legs are positioned at least proximate the table top. One or more sliding braces 66 may be used to facilitate movement of the support structures 54 between the use and collapsed positions. For example, the support structures 54 may be connected to a cross bar 68 and the sliding brace 66 may include a pin 70 is disposed within a slot 72. As the support structure 54 is moved between the use and collapsed positions, the pin 70 may move within the slot 72. In addition, the braces 66 may be used to lock the support structures 54 in a desired position, such as the use or collapsed position, if desired.

Figure 8:
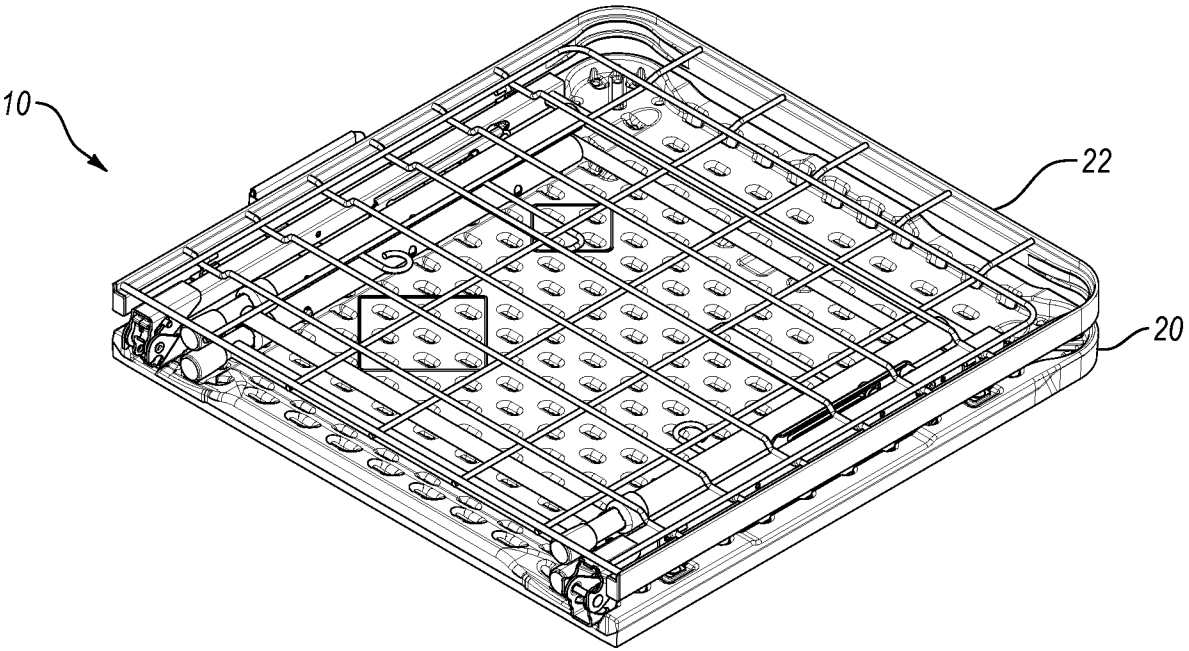
FIG. 8 is a perspective view of the table shown in FIG. 1, illustrating the table in the folded position.
Figure 9:
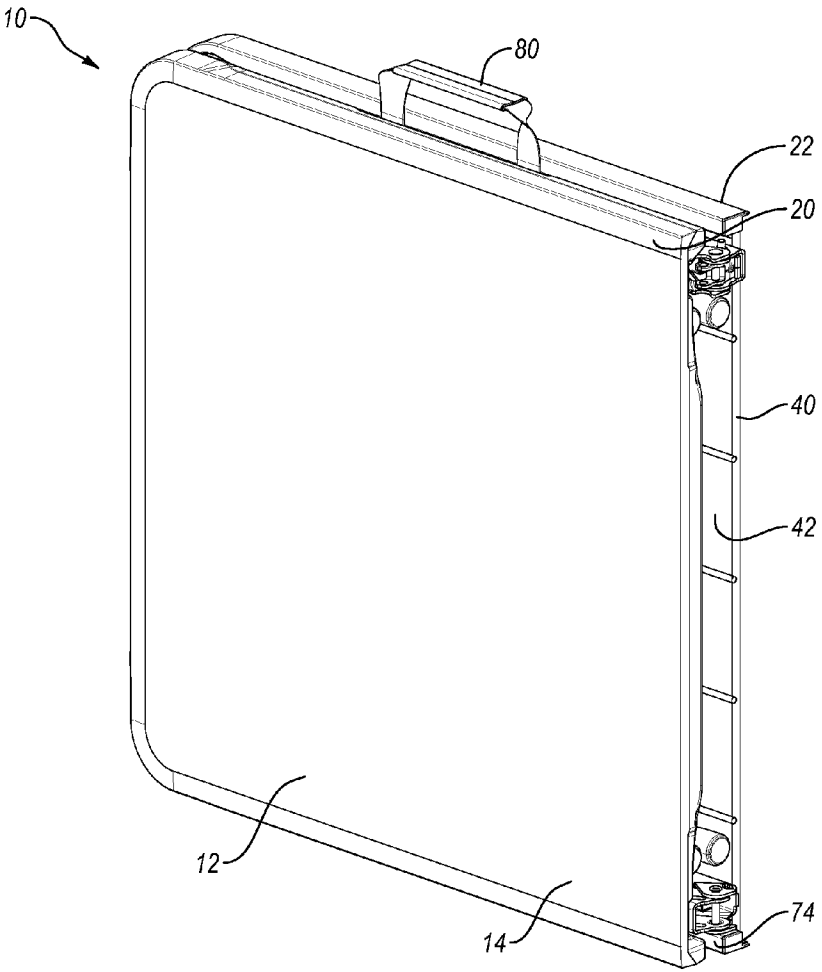
FIG. 9 is another perspective view of the table shown in FIG. 1, illustrating the table in the folded position.

As shown in the accompanying drawings, when the legs 56 are in the refracted position, the legs may have a length less than one-half the length of the table top 12, which may allow the support structure 54 to have a length less than one-half of the table top. In particular, as shown in FIG. 5, the legs 56 may be disposed in a use position and have an extended length. This may allow the table 10 to be disposed at a desired height. The legs 56 may be disposed in a retracted position as shown in FIG. 6, which may allow the support structures 54 to be disposed in a collapsed position as shown in FIG. 7. When the legs 56 are retracted and the support structures 54 are collapsed, then the table 10 can be folded as shown in FIGS. 8 and 9.

The support structures 54 may be connected to the table top 12 by a frame 74. For example, the cross bar 68 may be movably connected to the frame 74 to allow the support structures 54 to move between the outwardly extending or use position and the collapsed or storage position. In particular, the frame 74 may include elongated support members or side rails 76, 78 and the cross bar 68 may be connected to the side rails. It will be appreciated that the cross bar 68 may also be part of the frame 74. The side rails 76, 78 may extend along the length and/or width of the table top 12 and the side rails may help support the table top.

The support structures 54, the legs 56 and the cross bar 68 do not have to be connected to the frame 74. Instead, the support structures 54, the legs 56 and the cross bar 68 may be connected to any suitable portions of the table 10. It will also be appreciated that the table 10 may include any suitable number of the support structures 54, the legs 56 and the cross bar 68 depending, for example, upon the intended use of the table. It will further be appreciated that the table top 12, the support structures 54, the legs 56 and the braces 68 may have various sizes, shapes, configurations and arrangements depending, for example, upon the intended use of the table 10. It will further be appreciated that the table 10 may have other components, features, aspects, characteristics and the like, if desired.

The frame 74 may also be sized and configured to facilitate folding of the table 10. For example, the side rails 76, 78 of the frame 74 may be disposed along the sides of the table top 12. Advantageously, if the side rails 76, 78 are disposed proximate the sides of the table top 12, then the sides of the table top may be supported by the frame 74, which may help create a strong and sturdy table 10. In addition, the side rails 76, 78 may be sized and configured to help transfer forces towards a center portion of the table and away from the perimeter 18, which also help create a strong and sturdy table 10.

If the side rails 76, 78 are disposed below or proximate the lower portion of the lip 24 of the first portion 20 of the table top 12 and/or the outer wall 46 of the second portion 22 of the table top, then the frame 74 may help prevent the table top from being damaged. In particular, this may allow the frame 74 to absorb impacts or forces that otherwise may damage the table top 12. A lower portion of the side rails 76, 78 may also be generally aligned and coplanar with a lower portion of the lip 24 and the outer wall 46, which may facilitate stacking and/or folding of the table 10.

Figure 10:
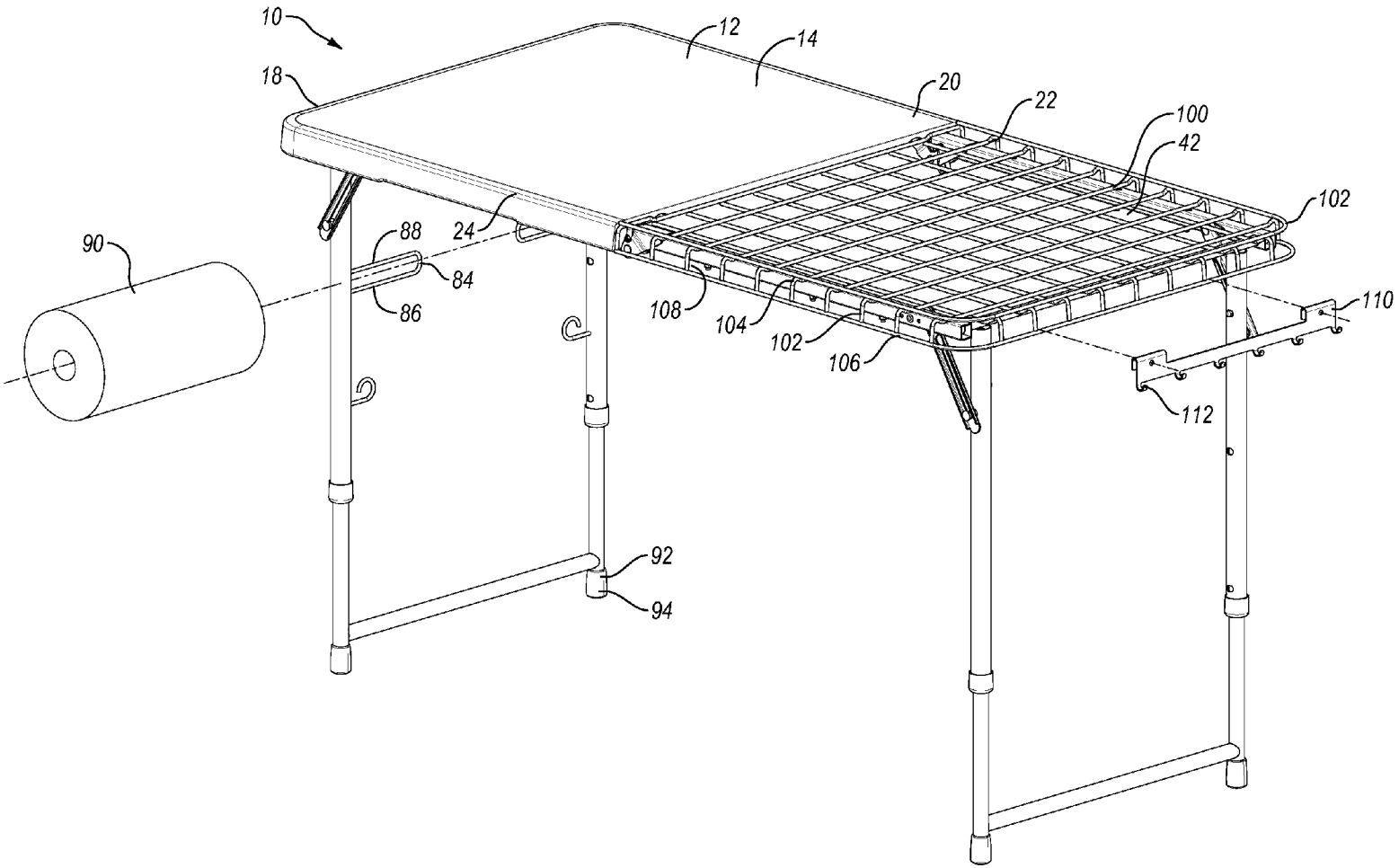
FIG. 10 is a partially exploded view of another exemplary table.
Figure 11:
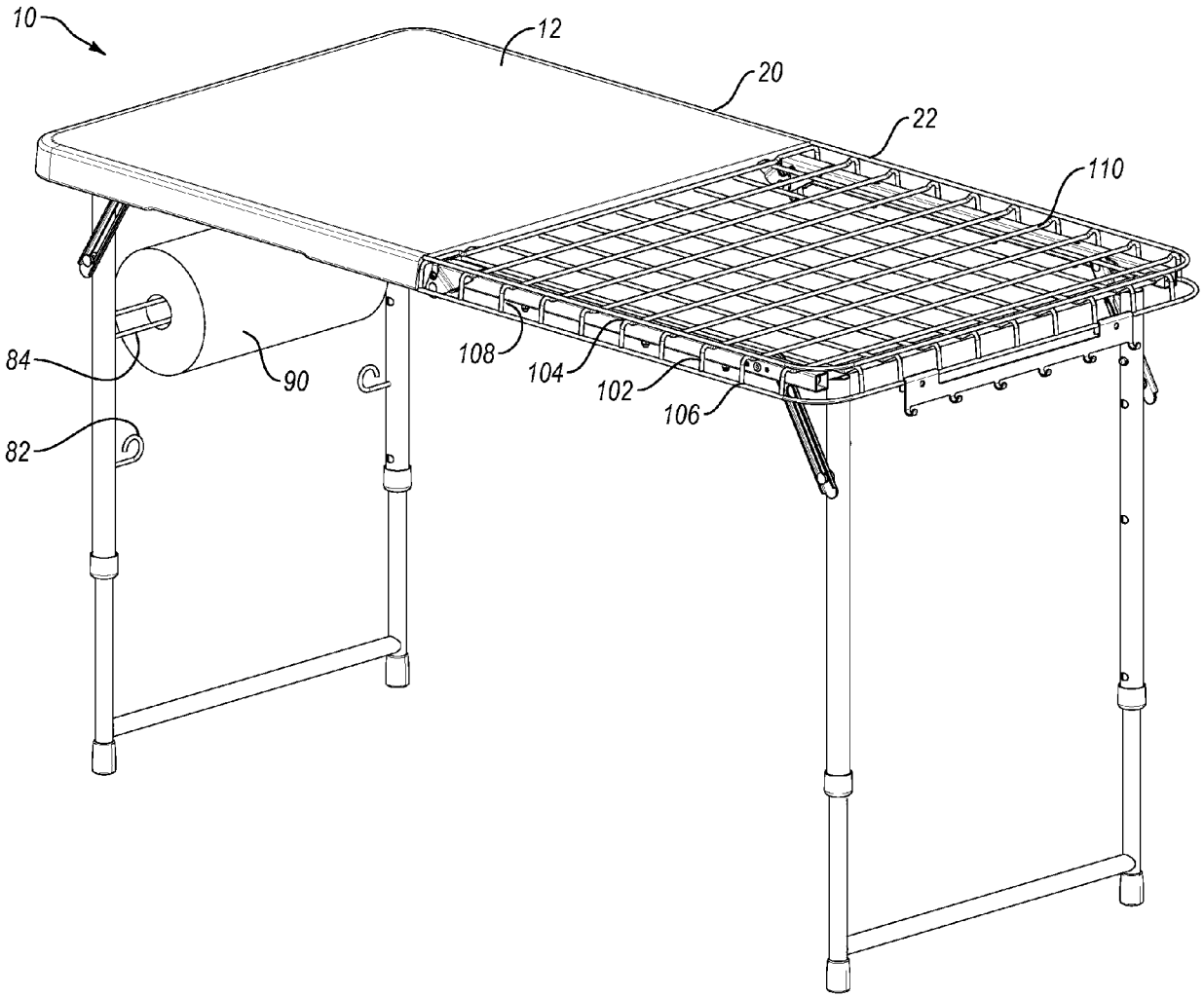
FIG. 11 is a perspective view of the table shown in FIG. 10, illustrating an exemplary roll of towels attached to a leg assembly.
Figure 13:
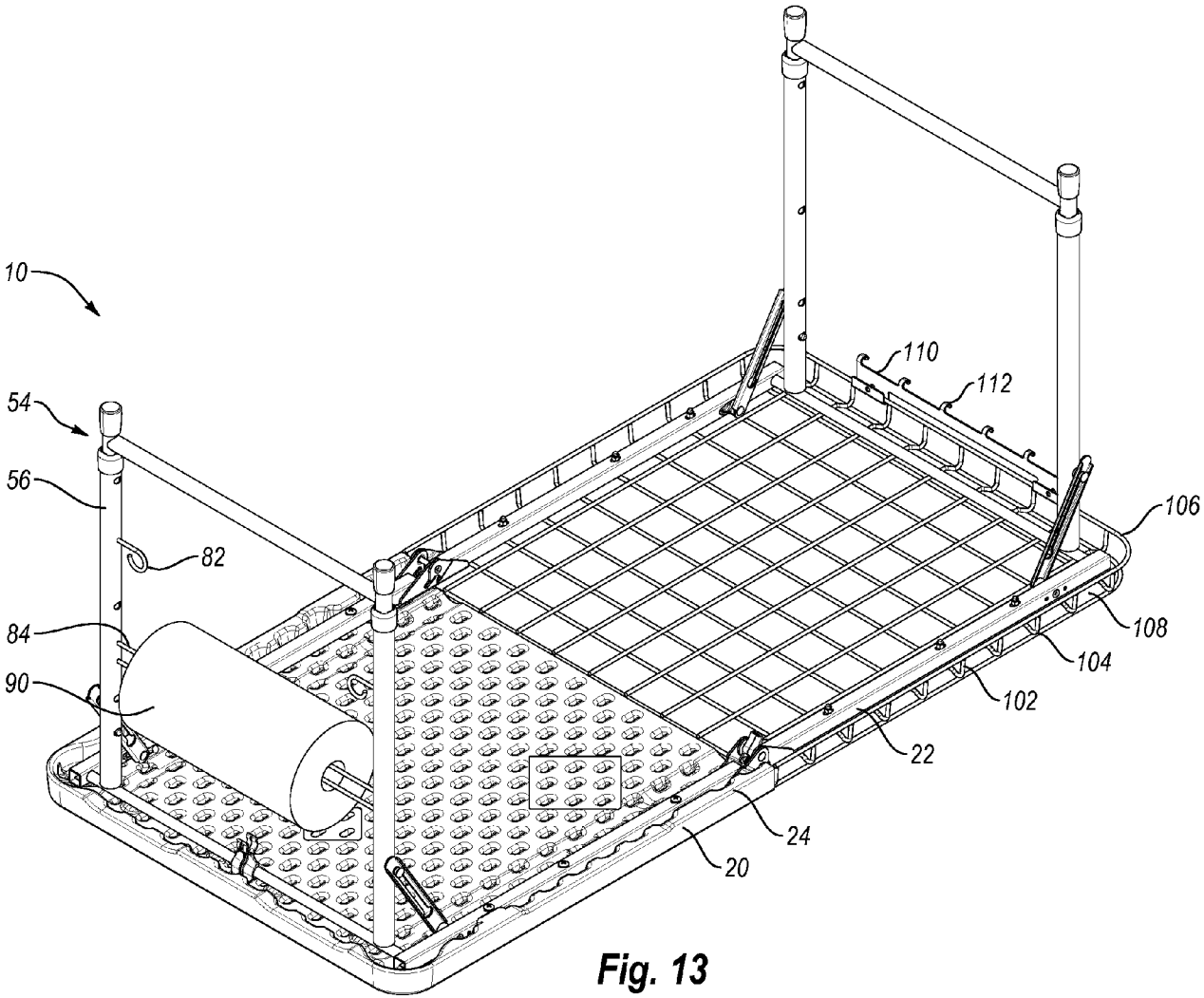
FIG. 13 is a lower perspective view of the table shown in FIG. 10.

As shown in the accompanying figures, the table 10 may include one or more features, which may be freely combined depending, for example, upon the intended use of the table. For example, the table 10 may include a handle 80 that is connected to a side rail 76 of the frame 74. The table 10 may also include one or more hooks 82 that may be connected to one of the support structures 54. The hooks 82 may be sized and configured to support items such as cooking utensils, tools and other types of devices. In addition, the table 10 may include racks or supports such as a towel rack 84. The towel rack 84 may also be connected to one of the support structures 54 and it may include first and second engaging portions 86, 88 that are sized and configured to support a roll of towels 90, as shown in FIGS. 10, 11 and 13.

The table 10 that may include one or more foot or end caps 92 attached to the feet 94 of the support structures 54 and/or legs 56. For example, the support structures 54 and/or the legs 56 may be constructed from tubular pieces of metal with a generally circular, oval, oblong, rectangular or other suitable cross-sectional configuration. The foot caps 92 may include a lower surface 96 that is sized and configured to engage a floor. In particular, the foot caps 92 are preferably sized and configured to allow the support structures 54 and/or legs 56 to rest securely and in a stable position relative to the floor. While the table 10 may include any number and combination of features, none of the features are required.

Figure 12:
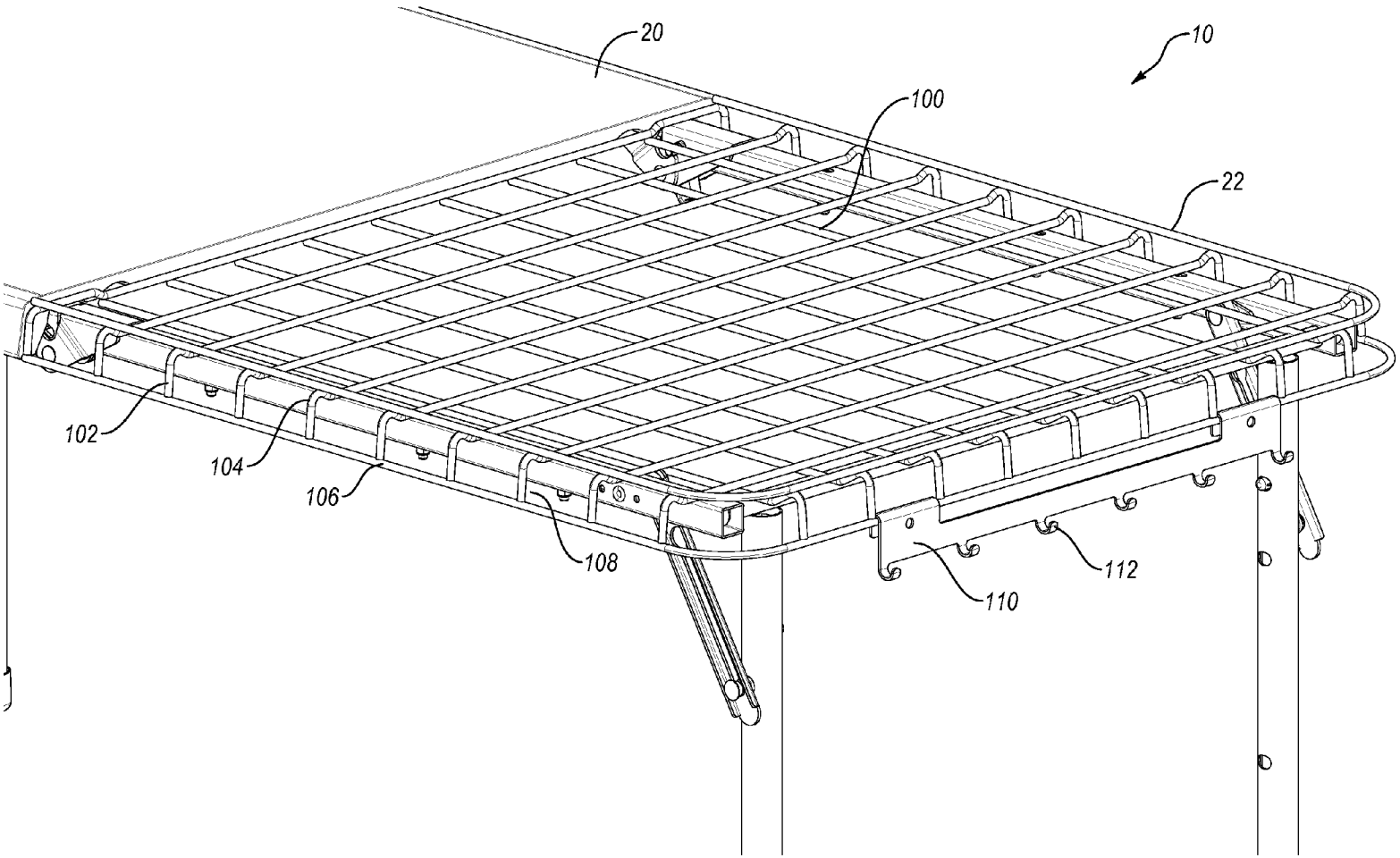
FIG. 12 is an enlarged view of a portion of the table shown in FIG. 10, illustrating an accessory connected to an end of the wire rack portion of the table top.

The table 10 may also have other exemplary embodiments such as shown in FIGS. 10 to 13. In this embodiment, the second portion 22 of the table top 12 may include metal supports 100 that also form a lip or outer edge 102. As best seen in FIG. 12, the metal supports 100 may include downwardly curved ends 104 which may be connected to a lower support member 106 to form the lip 102. The lip 102 may be generally aligned with and have the same configuration as the lip 24 from the first portion 20 of the table top 12. In addition, the lip 102 may include a plurality of openings 108.

The lip 102 may facilitate attachment of components to the table 10 such as a support bracket or holder 110. The holder 110 may be attached to the lower support member 106 and may include a number of hooks 112 or other support members. Advantageously, the holder 110 may be connected to various suitable portions of the table top 12.

Figure 14:
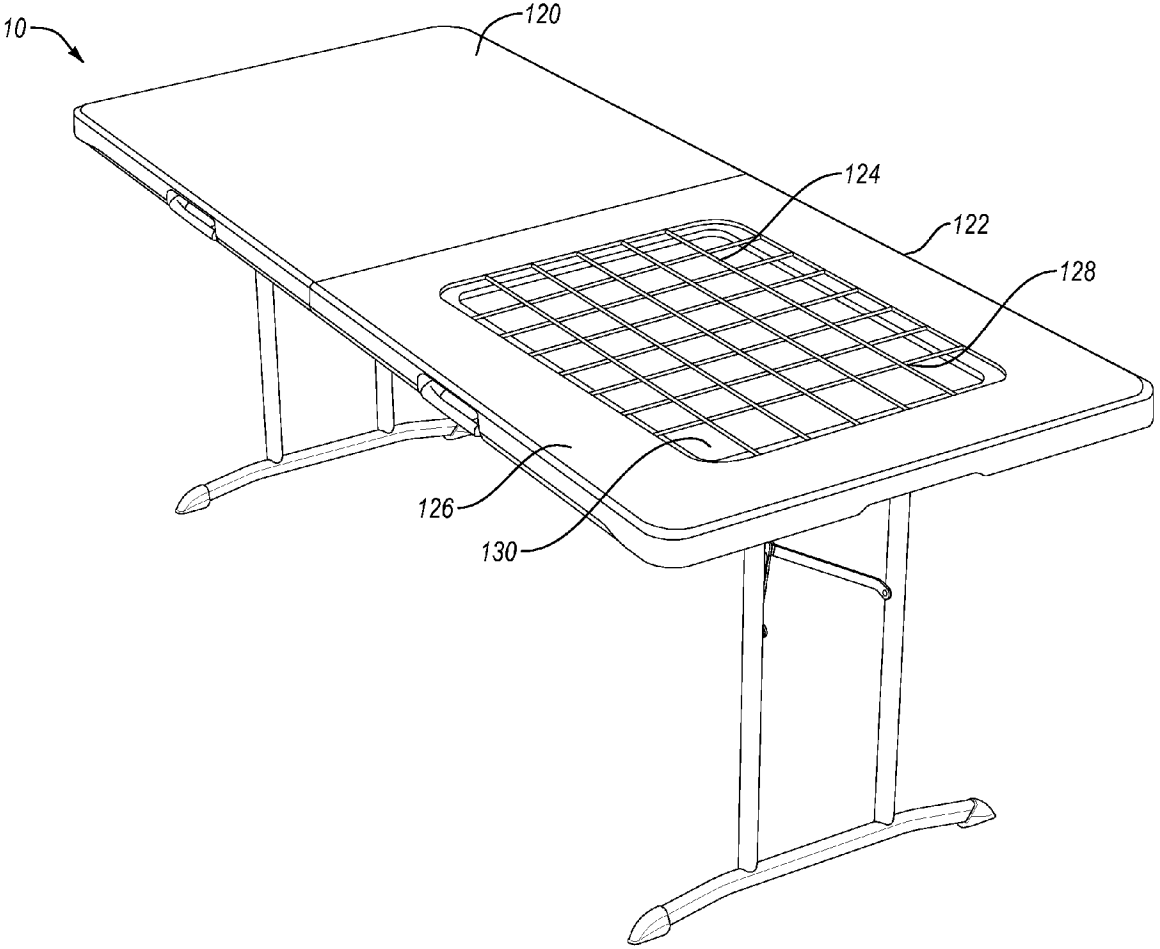
FIG. 14 is a perspective view of still another exemplary table.

Another exemplary embodiment of the table 10 is shown in FIG. 14 in which the table top 120 includes a second portion 122 in which the metal supports 124 are disposed within a border or frame 126. For example, as discussed above, the metal supports 124 may be disposed in a grid to form a wire rack 128, which may allow the table 10 to support items at an elevated temperature. The border 126 may have a similar construction and configuration as the first portion 20 of the table top 12, but include an opening 130 in which the wire rack 128 may be disposed.

One of ordinary skill in the art may appreciate after reviewing this disclosure that the tables disclosed herein may have a number of different aspects, features, characteristics and configurations. Further, a table may have any suitable number of aspects, features, characteristics and configurations depending, for example, upon the intended use of the table.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A fold-in-half table movable between a folded position and an unfolded position, the fold-in-half table comprising:

a table top comprising:

a first half constructed from molded plastic, the first half including a first inner engagement surface that extends across at least a portion of a width of the first half of the table top; and a second half constructed from metal, the second half including a second inner engagement surface that extends across at least a portion of a width of the second half of the table top, the first inner engagement surface disposed at least proximate the second inner engagement surface when the table is in the unfolded position, the first inner engagement surface spaced apart from the second inner engagement surface when the table is in the folded position;

a connecting member connecting the first half and the second half of the table top, the connecting member facilitating movement of the table top between an unfolded position in which the first half and the second half of the table top are at least generally aligned and a folded position in which the first half and the second half of the table top are not generally aligned;

a first support structure connected to the first half of the table top, the first support structure movable between an extended position and a collapsed position relative to the first half of the table top, the first support structure extending outwardly from the first half of the table top in the extended position, the first support structure disposed generally parallel and at least proximate the first half of the table top in the collapsed position; and a second support structure connected to the second half of the table top, the second support structure movable between an extended position and a collapsed position relative to the second half of the table top, the second support structure extending outwardly from the second half of the table top in the extended position, the second support structure disposed generally parallel and at least proximate the second half of the table top in the collapsed position.

2. The fold-in-half table as in claim 1, wherein the first inner engagement surface and the second inner engagement surface are generally aligned and disposed in a plane when the table is in the folded position.

3. The fold-in-half table as in claim 1, wherein the first half of the table top includes an upper surface, a lower surface and a hollow interior that are integrally formed as part of a unitary, one-piece structure during a blow-molding process.

4. The fold-in-half table as in claim 1, wherein the second half of the table top comprises a wire rack.

5. The fold-in-half table as in claim 1, wherein the first half of the table top is constructed from blow-molded plastic with an upper surface, a lower surface and a hollow interior portion that are integrally formed as part of a unitary, one-piece structure;

wherein the first inner engagement surface is integrally formed with the first half of the table top as part of the unitary, one-piece structure;

wherein the second half of the table comprises a wire rack; and wherein the second inner engagement surface at least partially engages the first inner engagement surface when the table is in the unfolded position.

6. The fold-in-half table as in claim 1, further comprising:

a first lip disposed about an outer perimeter of the first half of the table top; and an outer wall disposed about an outer perimeter of the second half of the table top;

wherein the first lip and the outer wall have a generally equal height.

7. The fold-in-half table as in claim 1, further comprising:

a first lip disposed about an outer perimeter of the first half of the table top;

an outer wall disposed about an outer perimeter of the second half of the table;

wherein a lower surface of the first lip is sized and configured to abut a lower surface of the outer wall when the table is in the folded position.

8. The fold-in-half table as in claim 1, wherein the first half of the table top has a first set of characteristics and properties;

wherein the second half of the table top has a second set of characteristics and properties; and wherein the first set of characteristics and properties is different than the second set of characteristics and properties.

9. The fold-in-half table as in claim 1, further comprising a plurality of openings in the second half of the table top, the openings covering at least a substantial portion of an upper surface of the second half of the table top.

10. The fold-in-half table as in claim 1, further comprising a plurality of openings in a lip of the second half of the table top.

11. A table movable between a folded position and an unfolded position, the table comprising:

a table top comprising:

a first half including an upper surface, a lower surface and a hollow interior that are integrally formed during a molding process as part of a unitary, one-piece construction;

a first inner engagement surface integrally formed with the first half of the table top as part of the unitary, one-piece construction;

a second half including a wire rack; and a second inner engagement surface of the second half of the table top, the first inner engagement surface disposed at least proximate the second inner engagement surface when the table is in the unfolded position, the first inner engagement surface spaced apart from the second inner engagement surface when the table is in the folded position;

a first frame member connected to the first half of the table top;

a second frame member connected to the second half of the table top;

a hinge assembly pivotally connecting the first half of the table top and the second half of the table top;

a first support structure connected to the first half of the table top, the first support structure movable between an extended position and a collapsed position relative to the first half of the table top, the first support structure extending outwardly from the first half of the table top in the extended position, the first support structure disposed generally parallel and at least proximate the first half of the table top in the collapsed position; and a second support structure connected to the second half of the table top, the second support structure movable between an extended position and a collapsed position relative to the second half of the table top, the second support structure extending outwardly from the second half of the table top in the extended position, the second support structure disposed generally parallel and at least proximate the second half of the table top in the collapsed position.

12. The table as in claim 11, wherein the first inner engagement surface and the second inner engagement surface are generally aligned and disposed in a plane when the table is in the folded position.

13. The table as in claim 11, wherein the upper surface, the lower surface, the hollow interior and the first engagement surface are integrally formed as part of the unitary, one-piece structure during a blow-molding process.

14. The table as in claim 11, wherein the second half of the table top comprises a wire rack.

15. The table as in claim 11, wherein the wire rack is disposed within a border to form the second half of the table top.

16. The table as in claim 11, further comprising:

a first lip disposed about an outer perimeter of the first half of the table top; and an outer wall disposed about an outer perimeter of the second half of the table top;

wherein the first lip and the outer wall have a generally equal height.

17. The table as in claim 11, further comprising:

a first lip disposed about an outer perimeter of the first half of the table top;

an outer wall disposed about an outer perimeter of the second half of the table;

wherein a lower surface of the first lip abuts at least a portion of a lower surface of the outer wall when the table is in the folded position.

18. The table as in claim 11, wherein the first half of the table top has a first set of characteristics and properties;

wherein the second half of the table top has a second set of characteristics and properties; and wherein the first set of characteristics and properties is different than the second set of characteristics and properties.

19. The table as in claim 11, further comprising a plurality of openings of the wire rack in the second half of the table top, the openings covering at least a substantial portion of an upper surface of the second half of the table top.

20. The table as in claim 19, further comprising a plurality of openings of the wire rack in a downwardly extending lip of the second half of the table top.

* * * * *

UNITED STATES PATENT AND TRADEMARK OFFICE

CERTIFICATE OF CORRECTION

PATENT NO. : 8,534,205 B1
APPLICATION NO. : 13/546670
DATED : September 17, 2013
INVENTOR(S) : Johnson et al.

It is certified that error appears in the above-identified patent and that said Letters Patent is hereby corrected as shown below:

In the Specification

In Column 9, Line 7, delete "refracted" and insert -- retracted --, therefor.

In Column 9, Line 38, delete "braces 68" and insert -- braces 66 --, therefor.

Signed and Sealed this
Twentieth Day of May, 2014

Michelle K. Lee

Michelle K. Lee
*Deputy Director of the United States Patent and Trademark Office*